US009509050B2

(12) United States Patent
Jung

(10) Patent No.: US 9,509,050 B2
(45) Date of Patent: Nov. 29, 2016

(54) PORTABLE DEVICE WITH CIRCUIT BOARD MOUNTED RADIATOR

(71) Applicant: Samsung Electronics Co., Ltd., Gyeonggi-do (KR)

(72) Inventor: Young-Hwan Jung, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 118 days.

(21) Appl. No.: 14/509,693

(22) Filed: Oct. 8, 2014

(65) Prior Publication Data

US 2015/0311590 A1 Oct. 29, 2015

(30) Foreign Application Priority Data

Apr. 24, 2014 (KR) ..... 10-2014-0049140

(51) Int. Cl.

| | |
|---|---|
| ***H01Q 1/12*** | (2006.01) |
| ***H01Q 7/06*** | (2006.01) |
| ***H01Q 1/27*** | (2006.01) |
| ***H01Q 1/24*** | (2006.01) |
| ***H01Q 1/52*** | (2006.01) |
| ***H01Q 7/04*** | (2006.01) |

(52) U.S. Cl.

CPC ..... *H01Q 7/06* (2013.01); *H01Q 1/243* (2013.01); *H01Q 1/273* (2013.01); *H01Q 1/52* (2013.01); *H01Q 7/04* (2013.01)

(58) Field of Classification Search

USPC ..... 343/718, 788, 702

See application file for complete search history.

(56) References Cited

U.S. PATENT DOCUMENTS

| | | | | |
|---|---|---|---|---|
| 6,825,751 | B1 * | 11/2004 | Kita | G06K 19/07762 340/10.52 |
| 2006/0074552 | A1 | 4/2006 | Naito et al. | |
| 2006/0160487 | A1 | 7/2006 | Nam et al. | |
| 2007/0120758 | A1 * | 5/2007 | Takahashi | G04G 21/04 343/788 |
| 2009/0096413 | A1 | 4/2009 | Partovi et al. | |
| 2010/0008336 | A1 | 1/2010 | Keidar et al. | |
| 2010/0024046 | A1 | 1/2010 | Johnson et al. | |
| 2010/0090824 | A1 | 4/2010 | Rowell et al. | |
| 2012/0235636 | A1 | 9/2012 | Partovi | |
| 2012/0255763 | A1 | 10/2012 | Baek et al. | |
| 2013/0005243 | A1 | 1/2013 | Royston | |
| 2013/0054863 | A1 | 2/2013 | Imes et al. | |
| 2013/0097348 | A1 | 4/2013 | Milbrandt | |
| 2013/0130757 | A1 | 5/2013 | Luo et al. | |
| 2013/0143327 | A1 | 6/2013 | Kim et al. | |
| 2013/0211290 | A1 | 8/2013 | Lee | |
| 2013/0234910 | A1 | 9/2013 | Oh et al. | |

FOREIGN PATENT DOCUMENTS

| | | |
|---|---|---|
| JP | 11-268460 | 10/1999 |
| JP | 4556794 | 10/2010 |

* cited by examiner

*Primary Examiner* — Hoang V Nguyen
*Assistant Examiner* — Hai Tran
(74) *Attorney, Agent, or Firm* — The Farrell Law Firm, P.C.

(57) ABSTRACT

A portable electronic device is provided, which includes a circuit board, and a radiator arranged along an edge of the circuit board on one side of the circuit board.

13 Claims, 7 Drawing Sheets

PORTABLE DEVICE WITH CIRCUIT BOARD MOUNTED RADIATOR

PRIORITY

This application claims priority under 35 U.S.C. §119(a) to Korean Patent Application Serial No. 10-2014-0049140, which was filed in the Korean Intellectual Property Office on Apr. 24, 2014, the entire content of which is incorporated herein by reference.

BACKGROUND

1. Field of the Invention

The present invention relates generally to a portable electronic device, and in particular, to a body-wearable portable electronic device having, for example, a communication function.

2. Description of the Related Art

An electronic device may output information stored therein as texts, sounds or images. As the degree of integration of electronic devices has increased, super-high speed and large capacitance wireless communication has been popularized, and various functions have been recently incorporated in a single mobile communication terminal. For example, in addition to a communication function, an entertainment function, such as game, a multimedia function such as music/video reproduction, a communication and security function for mobile banking, and the like, and a function such as schedule management or electronic wallet may be integrated into a single electronic device.

Portable electronic devices, for example, an electronic scheduler, a portable multimedia player, a mobile communication terminal, and a tablet Personal Computer (PC), are generally equipped with a flat display device and a battery, and have an appearance of either bar-type, a folder-type, or a slide-type. As electronic communication technologies develope, electronic devices that are miniaturized to be wearable on a body portion such as a wrist or a head are now being commercialized.

Depending on the functions of a single electronic device, the electronic device may require a plurality of antenna devices. For example, it is possible to access various communication networks having different service frequency bandwidths such as a commercial communication network, a wireless Local Area Network (LAN), Bluetooth, and a Near Field Communication (NFC) network.

However, even if a miniaturized and light electronic device, for example, a mobile communication terminal or a body-wearable electronic device, is equipped with a plurality of antenna devices, there may be a difficulty in securing a stable performance depending on the environment of the electronic device. For example, a mobile communication terminal may be used when a proximity wireless communication antenna device is disposed on the rear surface thereof. However, there may be restrictions in the placement of a proximity wireless communication antenna device on a body-wearable electronic device, because a rear surface of the body-wearable electronic device is worn in contact with a part of the body.

SUMMARY

The present invention has been made to solve at least the above-mentioned problems and/or disadvantages and to provide at least the advantages described below. Accordingly, an aspect of the present invention is to provide a portable electronic device that may facilitate placement of an antenna device while being miniaturized.

Another aspect of the present invention is to provide a portable electronic device that secures a stable operation characteristic of an antenna device while facilitating placement of the antenna device.

According to an aspect of the present invention, a portable electronic device is provided, which includes a circuit board, and a radiator disposed along an edge of a circuit board on one side of the circuit board.

BRIEF DESCRIPTION OF THE DRAWINGS

The above and other aspects, features, and advantages of certain embodiments of the present invention will be more apparent from the following detailed description, taken in conjunction with the accompanying drawings, in which.

DETAILED DESCRIPTION OF EMBODIMENTS OF THE PRESENT INVENTION

Figure 1:
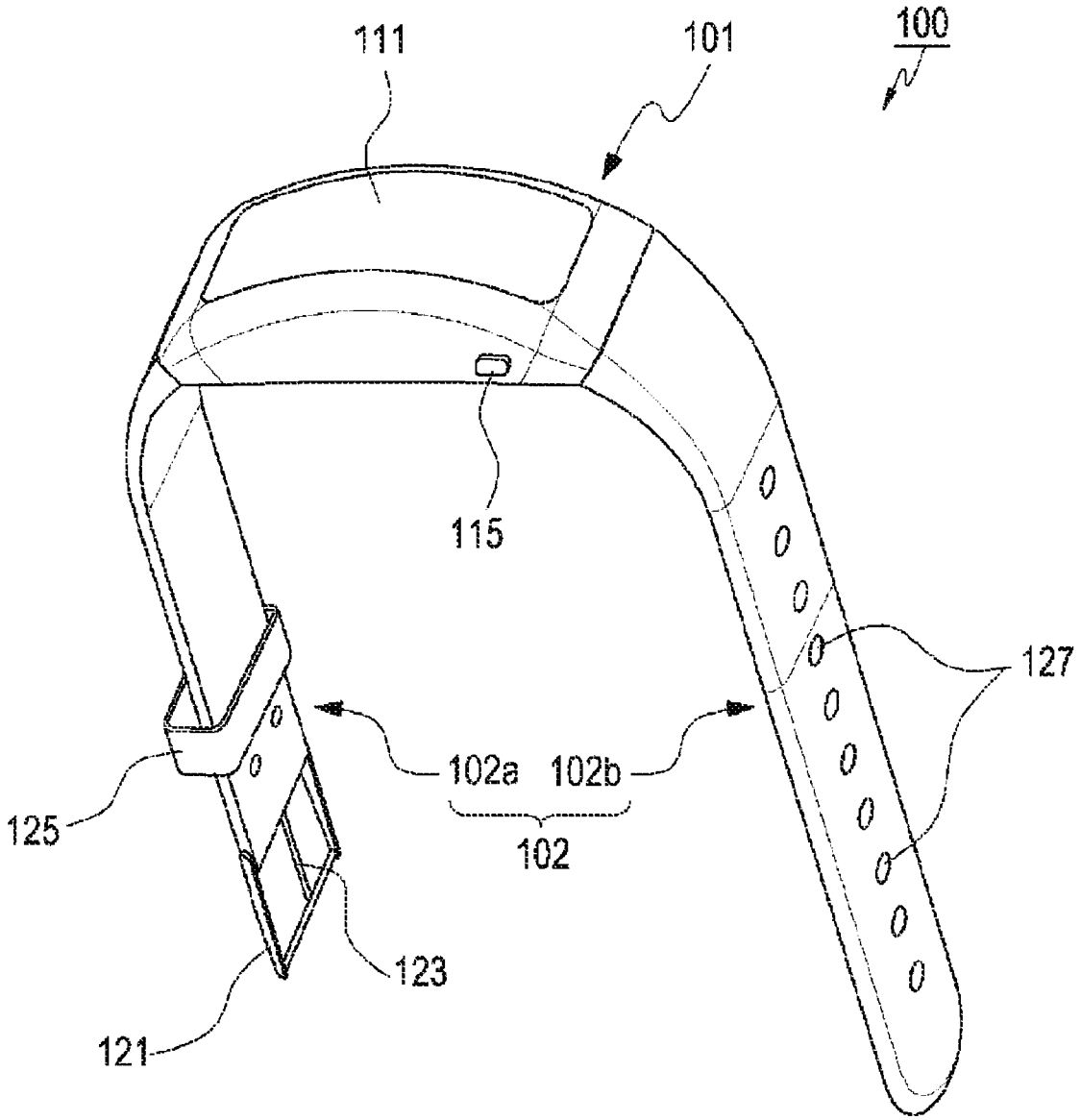
FIG. 1 is a perspective view illustrating a portable electronic device according to an embodiment of the present invention.

The present invention may have various modifications and embodiments and thus will be described with reference to specific embodiments in detail. However, it should be understood that the present invention is not limited to the specific embodiments, but the present invention includes all modifications, equivalents, and alternatives within the spirit and the scope of the present invention.

Although the terms including an ordinal number such as first, second, etc. can be used for describing various elements, the structural elements are not restricted by the terms. The terms are only used to distinguish one element from another element. For example, without departing from the scope of the present invention, a first structural element may be named a second structural element. Similarly, the second structural element also may be named the first structural element. As used herein, the term "and/or" includes any and all combinations of one or more associated items.

The relative terms, such as a front surface, a rear surface, an upper surface, and a lower surface, which are described with reference to the drawings may be replaced by ordinal numbers such as first and second. In the ordinal numbers such as first and second, their order are determined in the mentioned order or arbitrarily and may not be arbitrarily changed if necessary.

Herein, terms are used to describe a specific embodiment, and are not intended to limit the present invention. Singular forms are intended to include plural forms unless the context clearly indicates otherwise. In the description, it should be understood that the terms "include" or "have" indicate existence of a feature, a number, a step, an operation, a structural element, parts, or a combination thereof, and do not exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the present invention belongs. Such terms as those defined in a generally used dictionary are to be interpreted to have the meanings equal to the contextual meanings in the relevant field of art, and are not to be interpreted to have ideal or excessively formal meanings unless clearly defined in the present specification.

In the present invention, an electronic device may be a random device, and the electronic device may also be referred to as a terminal, a portable terminal, a mobile terminal, a communication terminal, a portable communication terminal, a portable mobile terminal, a display device, and the like.

For example, the electronic device may be a smartphone, a portable phone, a game player, a TV, a display unit, a heads-up display unit for a vehicle, a notebook computer, a laptop computer, a tablet PC, a Personal Media Player (PMP), a Personal Digital Assistants (PDA), etc. The electronic device may be implemented as a portable communication terminal which has a wireless communication function and is in a pocket size. Further, the electronic device may be a flexible device or a flexible display unit.

The electronic device may communicate with an external electronic device, such as a server, or perform an operation through an interworking with the external electronic device. For example, the electronic device may transmit an image photographed by a camera and/or position information detected by a sensor unit to the server through a network. The network may be a mobile or cellular communication network, a LAN, a Wireless LAN (WLAN), a Wide Area Network (WAN), an Internet, a Small Area Network (SAN), but is not limited thereto.

In accordance with an embodiment of the present invention, a portable electronic device is provided, which includes a circuit board and a radiator disposed along an edge of the circuit board on one side of the circuit board.

The portable electronic device may further include a recessed portion formed on the one side of the circuit board and the radiator may be accommodated in the recessed portion.

The portable electronic device may further include a ferrite member interposed between the radiator and the other side of the circuit board.

The ferrite member may be disposed between the radiator and a bottom surface of the recessed portion.

The portable electronic device may further include an opening formed in the recessed portion and a clip member supported on the bottom surface of the recessed portion, and an elastic piece of the clip member may be accommodated in the opening to be in contact with the radiator.

According to an embodiment, the clip member may include a fixed piece which is at least partially fixed around the opening, and the elastic piece may extend from the fixed piece.

The recessed portion may be opened to a lateral side of the circuit board.

The radiator may be configured by a conductor pattern formed along the edge of the circuit board on the one side of the circuit board.

The portable electronic device may further include a ferrite member placed on the other side of the circuit board.

The portable electronic device may further include a recessed portion formed on the one side of the circuit board, and the ferrite member may be accommodated in the recessed portion.

The ferrite member may be positioned to correspond to a region where the conductor pattern is formed.

The circuit board may include a fill-cut region formed between the conductor pattern and the ferrite member.

The portable electronic device may further include a board housing that accommodates the circuit board, and the radiator may be positioned to face a front side of the board housing.

The portable electronic device may further include wearing members which extend from the board housing in directions in which the wearing members are farther apart from each other.

The electronic device may further include a display device positioned on the front side of the body housing.

According to the aspects of the present invention, the portable electronic device may contribute to miniaturization and reduction of weight since an antenna device may be arranged so as not to increase the thickness of a circuit board. In addition, an antenna device may be easily situated even in an electronic device which is provided with a curved appearance in consideration of a user's convenience and appearance design, like a body-wearable electronic device.

Further, according to the aspects of the present invention, the portable electronic device may secure a stable operation characteristic in a state where it is worn on a body portion, since an antenna device may be placed on one side or the other of a circuit board of a circuit board in consideration of a state where the electronic device is worn on a part of the body.

Figure 2:
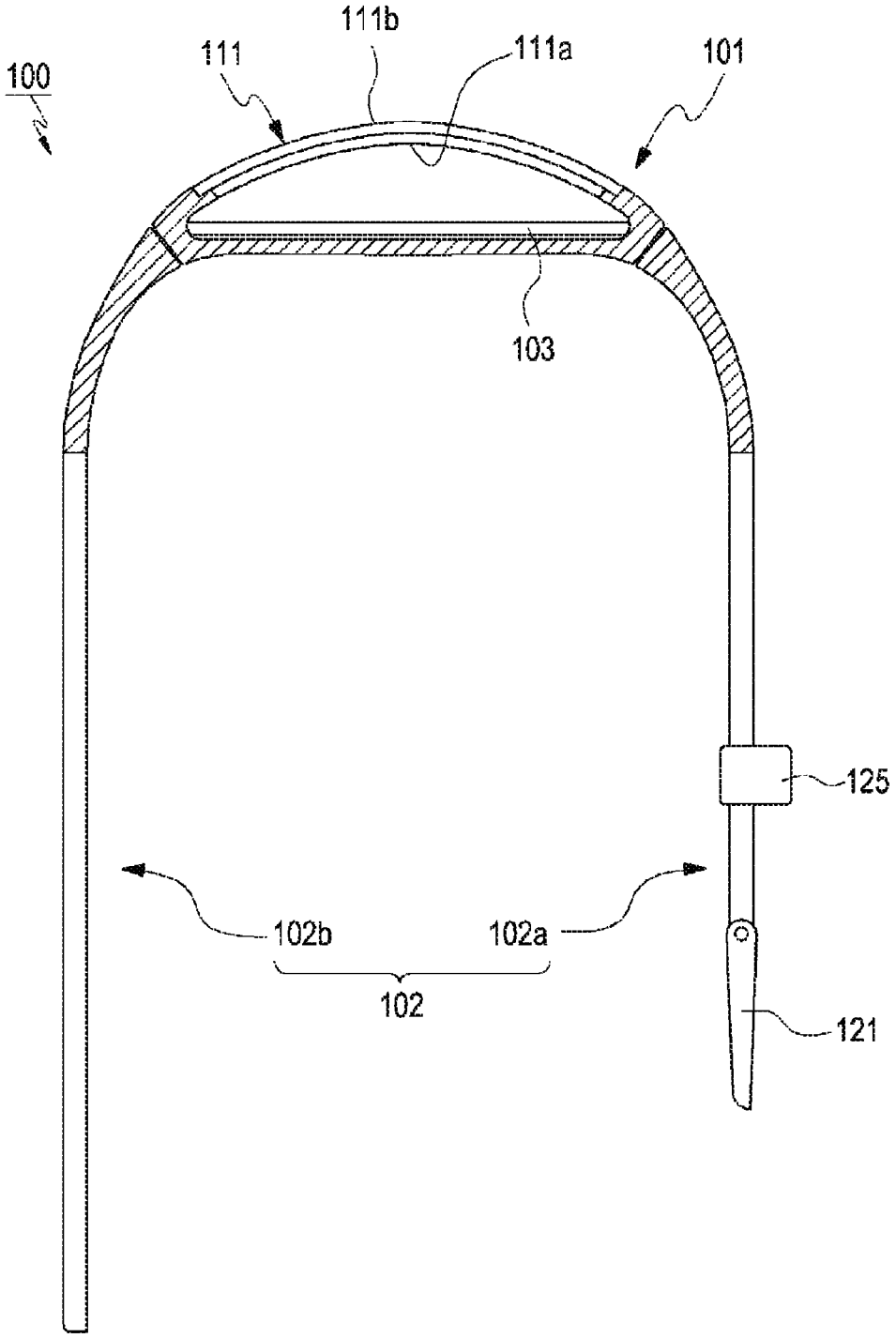
FIG. 2 is a sectional view of a portable electronic device according to an embodiment of the present invention.

FIG. 1 is a perspective view illustrating a portable electronic device according to an embodiment of the present invention. FIG. 2 is a sectional view of a portable electronic device according to an embodiment of the present invention.

Referring to FIGS. 1 and 2, a portable electronic device 100 includes a board housing 101 that accommodates a circuit board 103 and a wearing member 102. The electronic device 100 may be worn on a body portion of a user, such as a wrist, using the wearing member 102. For example, the board housing 101 may be tied on the user's wrist by the wearing member 102 extending from the board housing 101.

The board housing 101 includes a display device 111 mounted on a front side of the board housing 101, and a circuit board 103 accommodated in the board housing 101. The display device 111 includes a display module 111*a* that outputs a picture and a window member 111*b* positioned on the surface of the board housing 101. The display device 111 may be provided with a touch panel, for example, between the display module 111*a* and the window member 111*b* such that the display device 111 may be used as an input device. At least one physical key 115 is installed on the front side or a lateral side of the board housing 101. The physical key 115 may perform functions such as power ON/OFF and sleep mode switching.

The wearing member 102 ties the board housing 102 to a portion of the user's body. According to an embodiment of the present invention, the wearing member 102 is composed of first and second bands 102*a* and 102*b*. Each of the first and second bands 102*a* and 102*b* extends from the board housing 101 to be farther apart from each other and form a ring shape together with the board housing 101 when they are tied to each other. Here, the first and second bands may extend from different positions in different directions, and thus, it should be noted that the extending directions are not specifically defined. For example, when the first and second bands 102*a* and 102*b* are flexible or are pivotally coupled to the board housing 101, the first and second bands 102*a* and 102*b* may be positioned to be parallel to each other as illustrated in FIG. 2.

Fastening members 121 and 123 are provided on an end of the first band 102*a*, and fastening holes 127 corresponding to the fastening members 121 and 123 are formed on the second band 102*b*. Each of the fastening members 121 and 123 is tied to the end of the first band 102*a*. The first fastening member 121 has a frame shape so as to allow the second band 102*b* to pass therethrough. When the second fastening member 123 is engaged and fixed in one of the fastening holes 127 when the second band 102*b* passes through the first fastening member 121, the first and second bands 102*a* and 102*b* may form a ring shape together with the board housing 101. The first band 102*a* may be further provided with a band guide 125. A part of the second band 102*b*, which has passed through the first fastening member 121, may be maintained when it is closely contacted with the outer surface of the first band 102*a* by the band guide 125.

Figure 3:
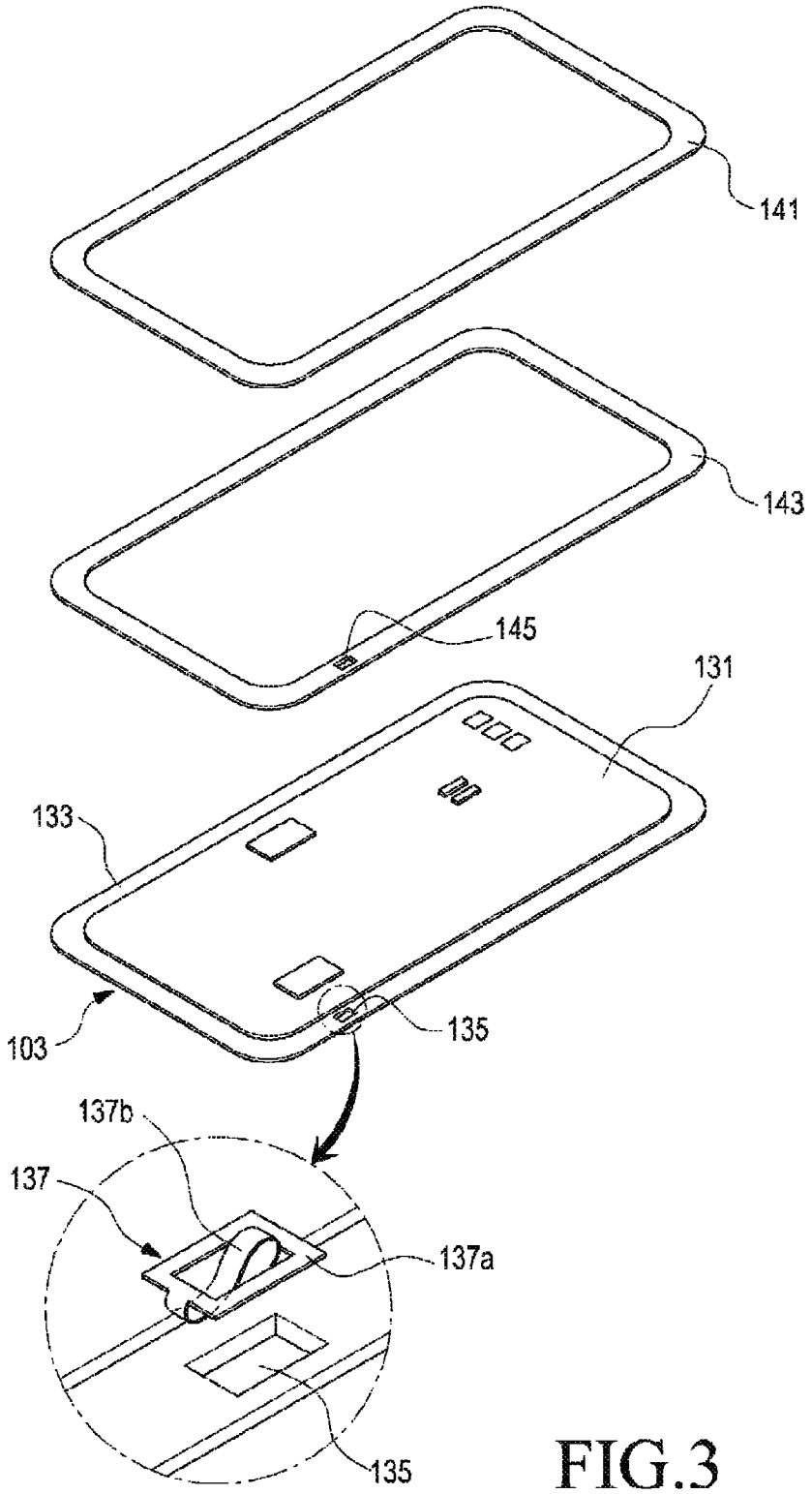
FIG. 3 is an exploded perspective view illustrating a circuit board of a portable electronic device according to an embodiment of the present invention.
Figure 4:
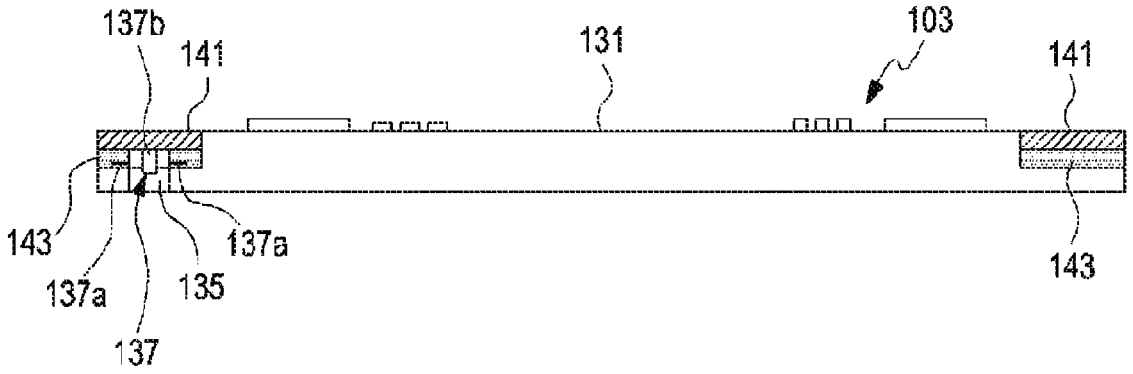
FIG. 4 is a cross-sectional view of a circuit board according to an embodiment of the present invention.

FIG. 3 is an exploded perspective view illustrating a circuit board according to an embodiment of the present invention. FIG. 4 is a cross-sectional view of a circuit board according to an embodiment of the present invention.

Referring to FIGS. 3 and 4, a radiator 141 is mounted on the circuit board 103. For example, the radiator 141 may be disposed along edges of the circuit board 103 on one surface of the circuit board 103. The illustrated radiator 141 has a closed loop shape but may be made of a flexible printed circuit board which is formed with a conductive pattern. The conductive pattern that forms the radiator 104 may be implemented in various forms, such as a helical form or a meander line form. Upon wearing the electronic device 100, the rear side of the board housing 101 may face or come into contact with a user's body portion. Accordingly, when the radiation direction of the antenna device is directed to the front side of the board housing 101, a stable operation may be secured. For example, the radiator 141 may be disposed such that it is positioned on one side of the circuit board 103 to face the front side of the board housing 101. The radiator 141 may be used as an NFC antenna that resonates at a frequency of about 13.56 MHz (for example, an electromagnetic inductive coupling type antenna).

In accordance with an embodiment of the present invention, the electronic device 100 further includes a ferrite member 143 having a shape corresponding to that of the radiator 141. The ferrite member 143 is disposed between the radiator 141 and the one side of the circuit board 103 to face the radiator 141, in which the ferrite member 143 controls the direction of a wireless signal emitted through the radiator 141 and suppresses interference between the radiator 141 and other circuit devices.

The one side of the circuit board 103 is composed of a component mounting region 131 and a recessed portion 133 provided around the component mounting region 131. The recessed portion 133 may be formed to be lower than the component mounting region 131. For example, the recessed portion 133 may be formed to be lower than the component mounting region 131 using a cavity method which removes a part of the circuit board 103. The recessed portion 133 may be exposed as part of the one side of the circuit board 103 and exposed at the periphery of the circuit board 103. An Application Processor (AP), a communication module, a memory, a sensor module, etc. may be mounted on the component mounting region 131. The configurations of such circuit devices will be described in detail below with reference to FIG. 9.

The radiator 141 and the ferrite member 143 may be accommodated and disposed in the recessed portion 133. When the radiator 141 is implemented by a flexible printed circuit board, the radiator 141 and the ferrite member 143 may be formed to have a thickness of about 0.25 mm and a width of about 2 mm. When the recessed portion 133 is formed to have a depth and a width which are equal to or larger than 0.25 mm and 2 mm, respectively, the radiator 141 and the ferrite member 143 may be disposed in the recessed portion 133 when they do not protrude either from the one side or lateral sides of the circuit board 103. Here, although upper limits of the depth and width of the recessed portion 133 are not specifically defined, a person ordinarily skilled in the art may properly set the limits in consideration of the thickness of the circuit board 103, the side of the component mounting region 131, etc. Since the thickness of the circuit board 103 can be maintained even though the radiator 141 is disposed on the circuit board 103, miniaturization and reduction of weight of an electronic device can be accomplished even if the radiator 141 and the circuit board 103 is equipped in the electronic device. In addition, an antenna device (for example, the radiator 141) may be easily disposed substantially within the mounting region of the circuit board in an electronic device fabricated in a curved line or curved plane shape considering wearing on a portion of the body.

The electronic device 100 includes a connection member or a clip member, for example, a C-clip 137, in order to connect the radiator 141 with a communication module mounted on the circuit board 103. The C-clip 137 is mounted on the recessed portion 133 to be connected with the communication module through a wiring of the circuit board 103. An opening 135 is formed in the recessed portion 133 to at least partially accommodate a part of the C-clip 137, for example, an elastic piece 137*b*. The C-clip 137 may include a fixed piece 137*a* which is fixedly mounted on the bottom surface of the recessed portion 133. At least a portion of the fixed piece 137*a* is fixed to the circumference of the opening 135, and another portion of the fixed piece 137*a* is disposed across the opening 135. The elastic piece 137*b* extends from the fixed piece 137*a*, in which a portion of the elastic piece 137*b* is positioned within the opening 135, and another portion protrudes from the bottom surface of the recessed portion 133.

When the radiator 141 is mounted on the recessed portion 133, the portion of the elastic piece 137*b*, which protrudes from the bottom surface of the recessed portion 133, comes into contact with the radiator 141 so as to connect the radiator 141 to the communication module. When the elastic piece 137*b* is in contact with the radiator 141, the elastic piece 137*b* may be turned back into the inside of the opening 135 and accommodated therein. For example, the radiator 141 may compress a portion of the elastic piece 137*b* while the radiator 141 is being mounted on the recessed portion 133, thereby causing the portion to be introduced into the opening 135. As a result, the C-clip 137 may connect the radiator 141 to the communication module without protruding from the one side or the other side of the circuit board 103. The ferrite member 143 may be interposed between the radiator 141 and the bottom surface of the recessed portion 133, and another opening 145 may be formed in the ferrite member 143 so as to provide a route through which the elastic piece 137*b* comes into contact with the radiator 141.

Figure 5:
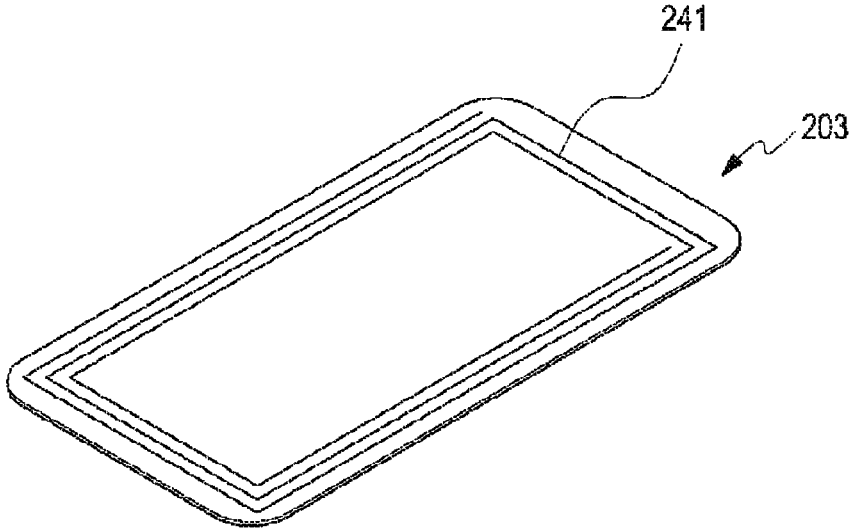
FIG. 5 is a perspective view illustrating a circuit board of a portable electronic device according to an embodiment of the present invention.
Figure 6:
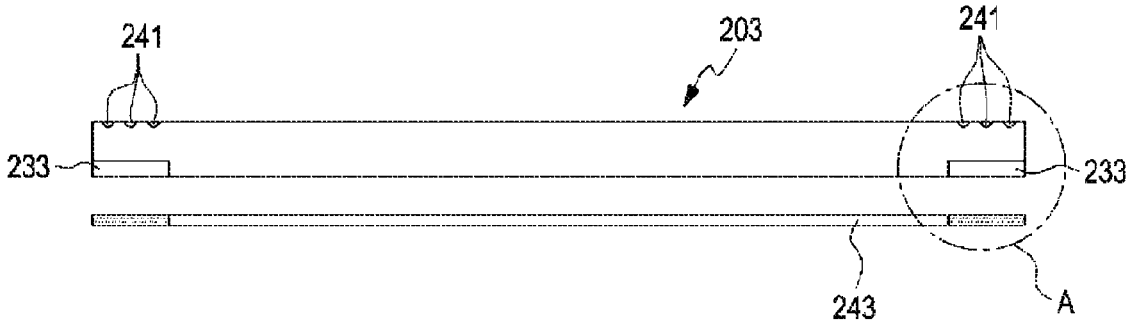
FIG. 6 is a cross-sectional view of a circuit board of a portable electronic device according to an embodiment of the present invention.
Figure 7:
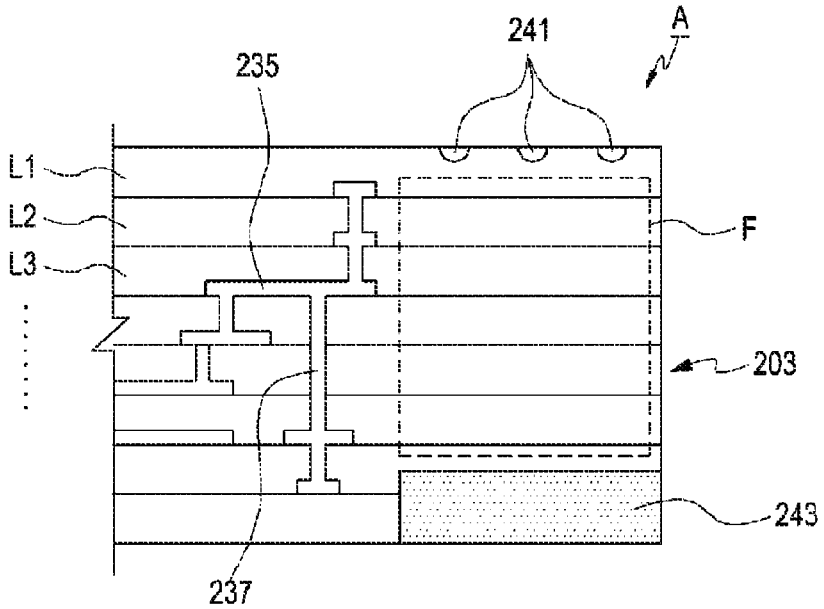
FIG. 7 is a partly enlarged cross-sectional view of a circuit board of a portable electronic device according to an embodiment of the present invention.

FIG. 5 is a perspective view illustrating a circuit board of a portable electronic device according to another embodiment of the present invention. FIG. 6 is a cross-sectional view of a circuit board of a portable electronic device according to another embodiment of the present invention. FIG. 7 is a partly enlarged cross-sectional view of a circuit board of a portable electronic device according to another embodiment of the present invention.

Referring to FIGS. 5 to 7, an electronic device utilizes a part of a conductive pattern formed on a circuit board 203 as a radiator 241.

The circuit board 203 is formed as a multi-layer printed circuit board, and a conductive pattern in any one layer that forms the circuit board 203 is configured as the radiator 241. For example, a part of the conductive pattern formed on the uppermost layer L1 of the circuit board 203 is formed in a helical shape along the edge of the circuit board 203 to constitute the radiator 241. Since the radiator 241 is configured by the conductive pattern formed on the circuit board 203, it is connected to a communication module through a wiring of the circuit board 203 even if a separate connection member is not disposed. Each of the layers L1, L2, L3 . . . that constitute the circuit board 203 is formed with a conductive pad or a wiring 235. If needed, conductive pads or wirings 235 in different layers may be connected with each other through via holes which penetrate respective layers or a conductive material 237 filled in the via holes.

A ferrite member 243 having a shape corresponding to the region where the radiator 241 is formed is attached to the circuit board 203. When the radiator 241 is formed on one side of the circuit board 203, the ferrite member 243 is attached to the other side of the circuit board 203. As an example of the distribution of wireless signal powers of the radiator 241, the radiation direction may be controlled using the ferrite member 243. The circuit board 203 includes a recessed portion 233. When the radiator 241 is formed on one side of the circuit board 203, the recessed portion 233 may be formed on the other side of the circuit board 203 to correspond to the region where the radiator 241 is formed. The ferrite member 243 is attached to the recessed portion 233 to be positioned correspondingly with the radiator 241. As a result, it is possible to attach the ferrite member 243 to the circuit board 203 while maintaining the thickness of the circuit board 203.

The circuit board 203 includes a fill-cut region F formed between the radiator 241 and the ferrite member 243. The fill-cut region F is a region where the conductive pads or wirings 235, the via holes, or the conductive material 237 filled in the via holes are not placed. The fill-cut region F ensures a stable operation of each of the radiator 241 and other circuit devices.

Figure 8:
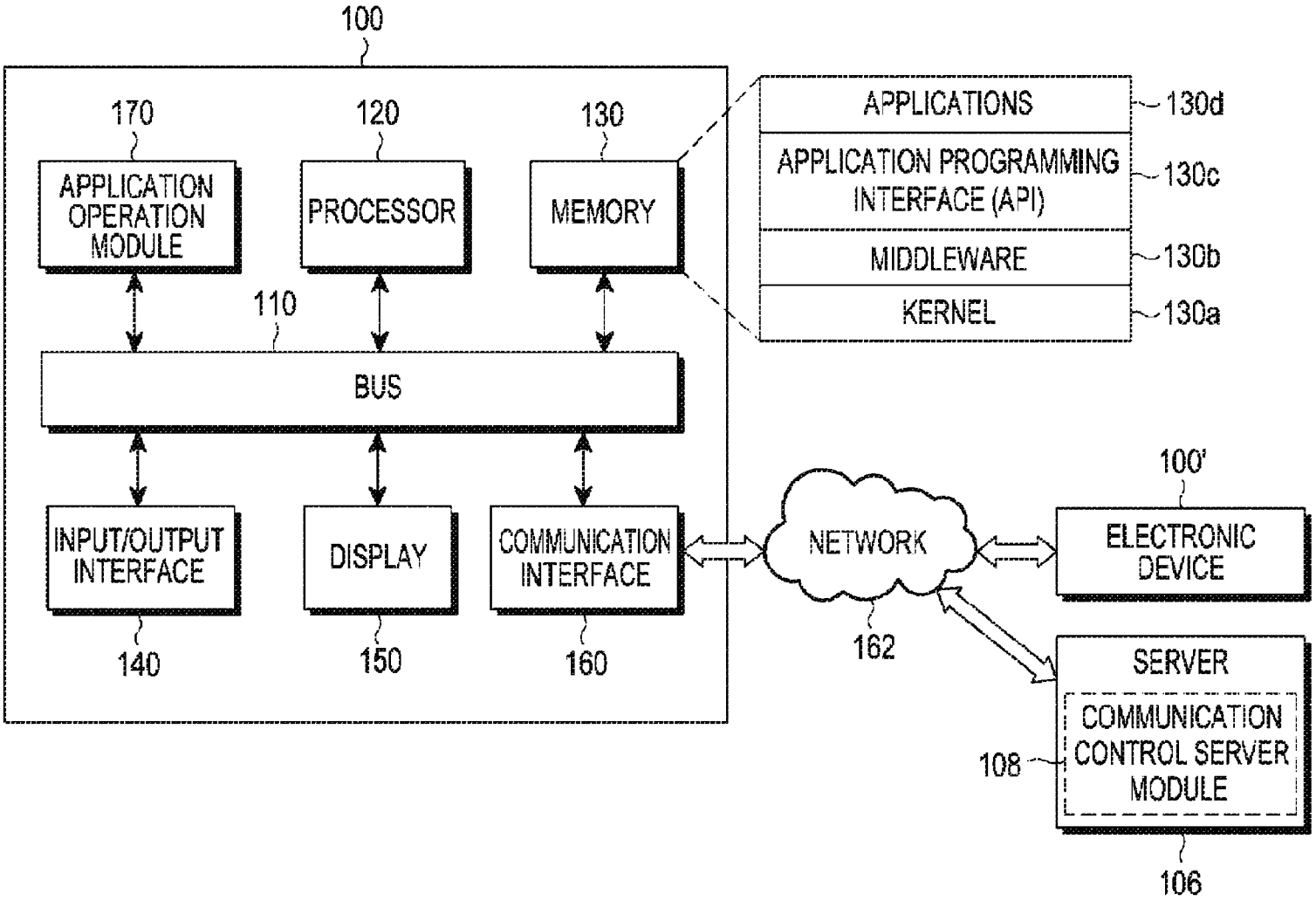
FIG. 8 illustrates a network environment including a portable electronic device according to an embodiment of the present invention.

FIG. 8 illustrates a network environment including a portable electronic device according to an embodiment of the present invention.

Referring to FIG. 8, the electronic device 100 includes a bus 110, a processor 120, a memory 130, an input/output interface 140, a display 150, a communication interface 160, and an application operation module 170.

The bus 110 includes a circuit that interconnects the above-described components and transfers a communication between the above-described components (for example, a control message).

The processor 120 receives commands from other above-described components (for example, the memory 130, the input/output interface 140, the display 150, the communication interface 160, or the application operation module 170) through, for example, the bus 110, decrypts the received commands, and executes an arithmetic operation or data processing according to the decrypted commands.

The memory 130 stores the commands or data received from or generated by the processor 120 or other components (for example, the input/output interface 140, the display 150, the communication interface 160, or the application operation module 170). The memory 130 may include programming modules, for example, a kernel 130*a*, a middleware 130*b*, an Application Programming Interface (API) 130*c*, or applications 130*d*. Each of the above-described programming modules may be configured by software, firmware, or hardware or a combination at least two of them.

The kernel 130*a* controls or manages system resources (for example, the bus 110, the processor 120 or the memory 130) which are used to execute an action or a function implemented in the other program modules (for example, the middleware 130*b*, the API 130*c* or the applications 130*d*). In addition, the kernel 130*a* provides an interface which may access individual components of the electronic device 100 from the middleware 130*b*, the API 130*c* or the applications 130*d* so as to control or manage the components.

The middleware 130*b* acts as an intermediary such that the API 130*c* or the applications 130*d* communicates with the kernel 130*a* so as to exchange data. In addition, in connection with task requests received from the applications 130*d*, the middleware 130*b* performs a control for the task requests (for example, scheduling or load balancing) by using a method of setting a priority of using the system resources of the electronic device 100 (for example, the bus 110, the processor 120 or the memory 130), for example, for at least one application among the applications 130*d*.

The API 130*c* is an interface that allows the applications 130*d* to control the functions provided from the kernel 130*a* or the middleware 130*b*, and may include, for example, at least one interface or function (for example, command) for performing, for example, a file control, a window control, an image processing or character control.

According to an embodiment of the present invention, the applications 130*d* may include, for example, a Short Message Service (SMS)/Multimedia Messaging Service (MMS) application, an e-mail application, a calendar application, an alarm application, a health care application (for example: an application that measures physical exercise, blood sugar, or the like) or an environmental information application (for example, an application that provides atmospheric pressure, humidity, temperature information, and the like). Alternatively, the applications 130*d* may be applications related to information exchange between the electronic device 100 and an external electronic device. The applications related to the information exchange may include, for example, a notification relay application for transferring specific information to the external electronic device, or a device management application for managing the external electronic device.

For example, the notification transferring application may include a function of transferring notification information generated in the other applications of the electronic device 100 (for example, the SMS/MMS application, the e-mail application, the health care application, or the environmental information application) to the external electronic device. Alternatively, the notification transferring application may receive notification information from, for example, the external electronic device and provide the notification information to the user. The device management application may manage (for example, install, delete or update), for example, at least some functions for the external electronic device which communicates with the electronic device 100 (for example: turn-on/turn-off of the external electronic device itself (or some components thereof) or tuning of brightness (or resolution) of a display), an application operated in the external electronic device, or a service provided from the external electronic device (for example, a communication service or a message service).

According to an embodiment of the present invention, the applications 130*d* may include an application designated according to a property of the external electronic device (for example, a kind of electronic device). For example, when the electronic device is an MP3 player, the applications 130*d* may include an application related to music reproduction. Similarly, when the external electronic device is a mobile medical appliance, the applications 130*d* may include an application related to health care. According to an embodiment of the present invention, the applications 130*d* may include at least one of an application designated to the electronic device 100 and an application received from other electronic devices (for example, a server 106 or the external electronic device).

The input/output interface 140 transfers commands or data input from the user through an input/output device (for example, a sensor, a keyboard or a touch screen) to the processor 120, the memory 130, the communication interface 160, or the application operation module 170, for example, through the bus 110. For example, the input/output interface 140 provides the data in relation to the user's touch which is input through the touch screen to the processor 120. In addition, the input/output interface 140 outputs commands or data received through, for example, the bus 110, from the processor 120, the memory 130, the communication interface 160, or the application operation module 170 through the input/output device (for example, the speaker or the display). For example, the input/output interface 140 outputs sound data processed through the processor 120 to the user through the speaker.

The display 150 displays various information items (for example, multimedia data or text data) to the user and may be implemented as the above-described display device 111.

The communication interface 160 connects communication between the electronic device 100 and other electronic devices (for example, the external electronic device or the server 106). For example, the communication interface 160 may be connected to the network 162 through wireless communication or wired communication to communicate with the external electronic device. The wireless communication may include at least one of, for example, Wireless Fidelity (WiFi), WiFi direct, Bluetooth (BT), NFC, Global Positioning System (GPS), or cellular communication (for example, Long-Term Evolution (LTE), LTE Advanced (LTE-A), Code Division Multiple Access (CDMA), Wideband CDMA (WCDMA), Universal Mobile Telecommunications System (UMTS), Wireless Broadband (WiBro), or Global System for Mobile Communications (GSM)). The wired communication may include at least one of, for example, Universal Serial Bus (USB), High Definition Multimedia Interface (HDMI), Recommended Standard 232 (RS-232), and Plain Old Telephone Service (POTS).

According to an embodiment of the present invention, the network 162 may be a telecommunications network. The communication network may include at least one of, for example, a computer network, internet, internet of things, and a telephone network. According to an embodiment of the present invention, a protocol for communication between the electronic device 100 and the external electronic device (for example, a transport layer protocol, a data link layer protocol, or a physical layer protocol) may be supported by at least one of the applications 130*d*, the API 130*c*, the middleware 130*b*, the kernel 130*a*, and the communication interface 160.

According to an embodiment of the present invention, the application operation module 170 supports the driving of the electronic device 100 by performing at least one action among the actions (or functions) implemented in the electronic device 100. For example, the server 106 includes a communication control server module 108 which is capable of supporting the application operation module 170 implemented in the electronic device 100. For example, the communication control server module 108 includes at least one of the components of the application operation module 170 and performs (for example, substitutes for) at least one actions performed by the application operation module 170.

Figure 9:
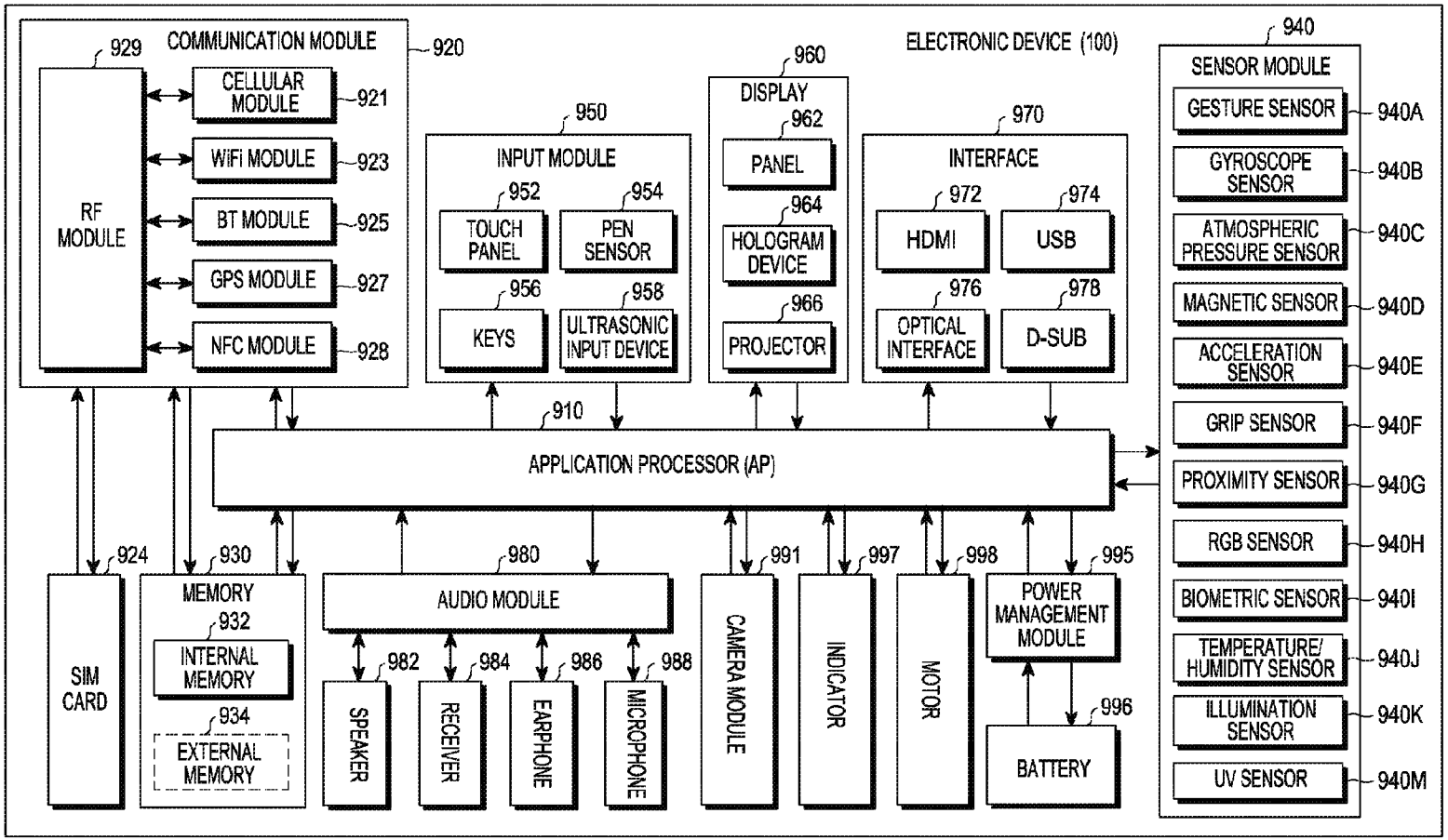
FIG. 9 illustrates a block diagram of a portable electronic device according to an embodiment of the present invention.

The application operation module 170 processes at least a part of information acquired from other components (for example, the processor 120, the memory 130, the input/output interface 140, the communication interface 160) and uses the processed information in various methods. For example, the application operation module 170 controls at least some functions of the electronic device 100 such that the electronic device 100 may be interlocked with other electronic devices (for example, the external electronic device or the server 106) by using the processor 120 or independently from the processor 120. The application operation module 170 may be integrated in the processor 120. According to an embodiment of the present invention, at least one configuration of the application operation module 170 may be included in the server 106 (for example, the communication control server module 108), and may be supported with at least one action implemented in the application operation module 170 from the server 106. Additional information for the application operation module 170 will be provided through FIG. 9. FIG. 9 illustrates a block diagram of a portable electronic device according to an embodiment of the present invention. Specifically, the electronic device 100 illustrated in FIG. 9 may constitute the whole or a part of the electronic device described above.

Referring to FIG. 9, the electronic device 100 includes at least one of an Application Processor (AP) 910, a communication module 920, a Subscriber Identification Module (SIM) card 924, a memory 930, a sensor module 940, an input module 950, a display 960, an interface 970, an audio module 980, a camera module 991, a power management module 995, a battery 996, an indicator 997, and a motor 998.

The AP 910 drives an operation system or an application program so as to control a plurality of hardware or software constituent elements connected to the AP 910, process various data including multimedia data, and perform an arithmetic operation. The AP 910 may be implemented using, for example, a System on Chip (SoC). According to an embodiment of the present invention, the AP 910 may further include a Graphic Processing Unit (GPU).

The communication module 920 (for example, the above-described communication interface 160 in FIG. 8) performs data transmission/reception in communication between the other electronic devices (for example, external electronic device or the server 106 in FIG. 8). According to an embodiment of the present invention, the communication module 920 includes at least one of a cellular module 921, a WiFi module 923, a BT module 925, a GPS module 927, an NFC module 928, and a Radio Frequency (RF) module 929.

The cellular module 921 provides voice communication, video communication, a text messaging service, an internet service, and the like, through a communication network (for example, LTE, LTE-A, CDMA, WCDMA, UMTS, WiBro or GSM). In addition, the cellular module 921 performs discrimination and authentication of an electronic device within a communication network using, for example, a subscriber identification module (for example, the SIM card 924). According to an embodiment of the present invention, the cellular module 921 performs at least some of functions which may be provided by the AP 910. For example, the cellular module 921 may perform at least a part of the multimedia control function.

According to an embodiment of the present invention, the cellular module 921 includes a Communication Processor (CP). In addition, the cellular module 921 may be implemented using, for example, an SoC. FIG. 9 illustrates the components such as the cellular module 921 (for example, the CP), the memory 930, and the power management module 995, as components separate from the AP 910. However, according to an embodiment of the present invention, the AP 910 may be implemented by at least some of the above-described components (for example, cellular module 921).

According to an embodiment of the present invention, the AP 910 or the cellular module 921 (for example, the CP) loads commands or data received from at least one of a non-volatile memory or other components connected to each of them in a volatile memory to process the commands or data. In addition, the AP 910 or the cellular module 921 stores data received from or generated by at least one of the other components in a non-volatile memory.

Each of the WiFi module 923, the BT module 925, the GPS module 927, and the NFC module 928 may include a processor that processes data transmitted/received through, for example, a corresponding module. FIG. 9 illustrates the cellular module 921, the WiFi module 923, the BT module 925, the GPS module 927 and the NFC module 928 as separate blocks. However, according to an embodiment of the present invention, at least some (for example, two or more) of the cellular module 921, the WiFi module 923, the BT module 925, the GPS module 927 and the NFC module 928 may be included in a single Integrated Chip (IC) or IC package. For example, at least some of the processors which respectively correspond to the cellular module 921, the WiFi module 923, the BT module 925, the GPS module 927, and the NFC module 928 (for example, the CP corresponding to the cellular module 921 and the WiFi processor corresponding to the WiFi module 923) may be implemented using a single SoC.

The RF module 929 performs data transmission/reception, for example, transmission/reception of RF signals. Although not illustrated, the RF module 929 may include, for example, a transceiver, a Power Amp Module (PAM), a frequency filter, or a Low Noise Amplifier (LNA). In addition, the RF module 929 may further include components for electromagnetic waves on a free space in wireless communication, for example, a conductor or a conducting wire. FIG. 9 illustrates that the cellular module 921, the WiFi module 923, the BT module 925, the GPS module 927, and the NFC module 928 share one RF module 929. However, according to an embodiment of the present invention, at least one of the cellular module 921, the WiFi module 923, the BT module 925, the GPS module 927, and the NFC module 928 may perform transmission/reception of RF signals through a separate RF module.

The SIM card 924 is a card including a subscriber identification module, and may be inserted into a slot formed in a specific position in the electronic device. The SIM card 924 may include intrinsic identification information (for example, Integrated Circuit Card Identifier (ICCID)) or subscriber information (for example, International Mobile Subscriber Identity (IMSI)).

The memory 930 (for example, the memory 130) includes a internal memory 932 or an external memory 934. The internal memory 932 may include at least one of, for example, a volatile memory (for example, a Dynamic RAM (DRAM), a Static RAM (SRAM), a Synchronous Dynamic RAM (SDRAM)) and a non-volatile memory (for example, a One Time Programmable ROM (OTPROM), a Programmable ROM (PROM), an Erasable and Programmable ROM (EPROM), an Electrically Erasable and Programmable ROM (EEPROM), a mask ROM, a flash ROM, a NAND flash memory, and NOR flash memory).

According to an embodiment of the present invention, the external memory 934 may be a Solid State Drive (SSD). The external memory 934 may further include a flash drive, for example, a Compact Flash (CF), a Secure Digital (SD), a Micro-Secure Digital (Micro-SD), a Mini-Secure Digital (Mini-SD), an extreme digital (xD), or a memory stick. The external memory 934 may be functionally connected with the electronic device 100 through various interfaces. According to an embodiment of the present invention, the electronic device 100 may further include a storage device (storage medium) such as a hard drive.

The sensor module 940 measures a physical amount or an operating state of the electronic device 100 and converts the measured or sensed information into an electric signal. The sensor module 940 includes at least one of, for example, a gesture sensor 940A, a gyroscope sensor 940B, an atmospheric pressure sensor 940C, a magnetic sensor 940D, an acceleration sensor 940E, a grip sensor 940F, a proximity sensor 940G, a color sensor 940H (for example, an RGB (red, green, blue) sensor), a biometric sensor 940I, a temperature/humidity sensor 940J, an illumination sensor 940K, and an Ultra-Violet (UV) sensor 940M. Alternatively, the sensor module 940 may include, for example, an Electronic nose sensor (E-nose sensor), an ElectroMyoGgraphy (EMG), an ElectroEncephaloGram (EEG) sensor, an ElectroCardioGram (ECG) sensor, an Infra-Red (IR) sensor, a iris sensor, or a fingerprint sensor. The sensor module 940 may further include a control circuit that controls one or more sensors included therein.

The input module 950 includes a touch panel 952, a (digital) pen sensor 954, a key 956, or an ultrasonic input device 958. The touch panel 952 recognizes a touch input using, for example, at least one of capacitive, pressure-sensitive, infra-red, and ultrasonic methods. In addition, the touch panel 952 may further include a control circuit. A capacitive touch sensor recognizes physical contact or proximity. The touch panel 952 may further include a tactile layer. In such a case, the touch panel 952 may provide a feeler response to the user.

The (digital) pen sensor 954 may be implemented, for example, with a method which is the same as or similar to receiving a user's touch input or by using a separate recognition sheet. The key 956 may include, for example, a physical button, an optical key, or a keypad. The ultrasonic input device 958 is a device that may sense a sound wave using a microphone (for example, a microphone 988) in the electronic device through an input instrument that generates an ultrasonic signal so as to confirm data. The ultrasonic input device 958 performs wireless recognition. According to an embodiment of the present invention, the electronic device 100 may receive a user input using the communication module 920 from an external electronic device (for example, a computer or a server) connected to the communication module 920.

The display 960 (for example, the display 150 in FIG. 8) includes a panel 962, a hologram device 964, or a projector 966. The panel 962 may be, for example, a liquid crystal display (LCD) or an Active-Matrix Organic Light-Emitting Diode (AM-OLED). The panel 962 may be configured, for example, to be flexible, transparent, or wearable. The panel 962 may be configured as a single module together with the touch panel 952. The hologram device 964 shows a stereoscopic image in the air using interference of light. The projector 966 projects light to a screen to display an image. The screen may be positioned, for example, inside or outside the electronic device 100. According to an embodiment of the present invention, the display 960 may further include a control circuit that controls the panel 962, the hologram device 964, or the projector 966.

The interface 970 includes, for example, a High-Definition Multimedia Interface (HDMI) 972, a USB 974, an optical interface 976, or a D-subminiature (D-sub) 978. The interface 970 may include, for example, the communication interface 160 illustrated in FIG. 8. Alternatively, the interface 970 may include, for example, a Mobile High-Definition Link (MHL) interface, a Secure Digital (SD) card/Multi-Media Card (MMC) interface, or an (Infrared Data Association (IrDA) standard interface.

The audio module 980 bi-directionally converts sound and electric signals. At least some components of the audio module 980 may be included, for example, in the input/output interface 140 illustrated in FIG. 8. The audio module 980 processes sound information input or output through, for example, the speaker 982, the receiver 984, the earphone 986, or the microphone 988.

The camera module 991 is a device capable of photographing a still image or a video image. According to an embodiment of the present invention, the camera module 991 includes one or more image sensors (for example, a front sensor or a rear sensor), a lens, an image signal processor (ISP), or a flash (including, for example, an LED or a xenon lamp).

The power management module 995 manages the power of the electronic device 100. Although not illustrated, the power management module 995 may include, for example, a Power Management Integrated Circuit (PMIC), a charger Integrated Circuit (IC), or a battery or fuel gauge.

The PMIC may be installed in, for example, an integrated circuit or an SoC semiconductor. The charging method may be classified into a wired method and a wireless method. The charger IC may charge the battery and may prevent inflow of overvoltage or overcurrent from a charger. According to an embodiment of the present invention, the charger IC may include at least one charger IC for use in the wired charging method and the wireless charging method. The wireless charging method may include, for example, a magnetic resonance method, a magnetic induction method, or an electromagnetic wave method, and an additional circuit for wireless charging, such as coil loop, a resonance circuit, or a rectifier circuit, may be added.

The battery gauge measures, for example, a residual capacity of the battery 996, a voltage, a current or a temperature during charging. The battery 996 stores or generate electricity and provide power to the electronic device 100 using the stored or generated electricity. The battery 996 may include, for example, a rechargeable battery or a solar battery.

The indicator 997 indicates a specific status of the electronic device 100 or a part thereof (for example, the AP 910), for example, a booting status, a message status, or a charging status. The motor 998 converts an electronic signal into mechanical vibration. Although not illustrated, the electronic device 100 may include a processing unit (e.g., GPU) for mobile TV support. The processing unit for supporting the mobile TV may process, for example, media data according to a standard of Digital Multimedia Broadcasting (DMB), Digital Video Broadcasting (DVB), media flow, and the like.

The aforementioned elements of the electronic device according to various embodiments of the present invention may be configured with one or more components, and the name of the corresponding element may vary depending on a type of the electronic device. The electronic device according to the various embodiments of the present invention may include at least one of the aforementioned elements or may further include other additional elements, or some of the aforementioned elements may be omitted. Also, a few of component elements of an electronic device according to various embodiments of the present invention are coupled to form a single entity, and may equivalently execute functions of the corresponding component elements which are not coupled.

The "module" used in various embodiments of the present invention may refer to, for example, a "unit" including one of hardware, software, and firmware, or a combination of two or more of the hardware, software, and firmware. The "module" may be interchangeable with a term, such as a unit, a logic, a logical block, a component, or a circuit. The "module" may be a minimum unit of an integrated component element or a part thereof. The "module" may be a minimum unit for performing one or more functions or a part thereof. The "module" may be mechanically or electronically implemented. For example, the "module" according to various embodiments of the present invention may include at least one of an Application-Specific Integrated Circuit (ASIC) chip, a Field-Programmable Gate Arrays (FPGAs), and a programmable-logic device for performing operations which have been known or are to be developed hereafter.

According to various embodiments, at least part of a device (for example, modules or functions thereof) or a method (for example, operations) according to the various embodiments of the present invention may be embodied by, for example, an instruction stored in a computer readable storage medium provided in a form of a programming module. When he command is executed by one or more processors (for example, the processor 120 in FIG. 8), the one or more processors may execute a function corresponding to the command. The computer readable storage media may be, for example, the memory 130 in FIG. 8. At least a part of the programming module may be implemented (for example, executed) by, for example, the processor 120 in FIG. 8. At least a part of the programming module may include, for example, a module, a program, a routine, a set of instructions, or a process for performing at least one function.

The computer-readable recording medium may include magnetic media such as a hard disk, a floppy disk, and a magnetic tape, optical media such as a Compact Disc ROM (CD-ROM) and a Digital Versatile Disc (DVD), magneto-optical media such as a floptical disk, and hardware devices specially configured to store and perform a program instruction (for example, programming module), such as a ROM, a RAM, a flash memory, and the like. Further, the program commands may include high class language codes that can be executed in a computer by using an interpreter, as well as machine language codes that are made by a compiler. The aforementioned hardware device may be configured to operate as one or more software modules in order to perform the operation of various embodiments of the present invention, and vice versa.

A programming module according to the present invention may include at least one of the described component elements, a few of the component elements may be omitted, or additional component elements may be included. Operations executed by a module, a programming module, or other component elements according to various embodiments of the present invention may be executed sequentially, in parallel, repeatedly, or in a heuristic manner. Also, a few operations may be executed based on a different order, may be omitted, or may additionally include another operation.

While the present invention has been shown and described with reference to certain embodiments thereof, it will be understood by those skilled in the art that various changes in form and details may be made therein without departing from the spirit and scope of the present invention as defined by the appended claims. For example, although a wearable electronic apparatus has been described as a specific embodiment of the present invention, it should be noted that the present invention can also be applied to an electronic apparatus, which is not wearable.

What is claimed is:

1. A portable electronic device comprising:

a circuit board;

a recessed portion formed on a first side of the circuit board;

an opening formed in the recessed portion;

a clip member supported on a surface of the recessed portion; and a radiator accommodated in the recessed portion and disposed along an edge of the circuit board on the first side of the circuit board, wherein an elastic piece of the clip member is accommodated in the opening to be in contact with the radiator.

2. The portable electronic device of claim 1, further comprising a ferrite member interposed between the radiator and the first side of the circuit board.

3. The portable electronic device of claim 2, wherein the ferrite member is disposed between the radiator and the surface of the recessed portion.

4. The portable electronic device of claim 1, wherein the clip member includes a fixed piece which is at least partially fixed around the opening, and the elastic piece extends from the fixed piece.

5. The portable electronic device of claim 1, wherein the recessed portion is exposed at a periphery of the circuit board.

6. The portable electronic device of claim 1, wherein the radiator utilizes a conductive pattern formed along the edge of the circuit board on the first side of the circuit board.

7. The portable electronic device of claim 1, further comprising a board housing that accommodates the circuit board, wherein the radiator is disposed to face a front side of the board housing.

8. The portable electronic device of claim 7, further comprising two wearing members that extend from the board housing in opposite directions.

9. The portable electronic device of claim 7, further comprising a display device positioned on the front side of the board housing.

10. A portable electronic device comprising:

a circuit board;

a radiator disposed along an edge of the circuit board on a first side of the circuit board; and a ferrite member disposed on a second side of the circuit board, wherein the circuit board includes a fill-cut region formed between a conductive pattern and the ferrite member.

11. The portable electronic device of claim 10, further comprising a recessed portion formed on the second side of the circuit board, wherein the ferrite member is accommodated in the recessed portion.

12. The portable electronic device of claim 10, wherein a shape of the ferrite member corresponds to a region where the conductive pattern is formed.

13. The portable electronic device of claim 10, wherein the radiator utilizes the conductive pattern formed along the edge of the circuit board on the first side of the circuit board.

* * * * *